US006230724B1

(12) United States Patent
Lai

(10) Patent No.: US 6,230,724 B1
(45) Date of Patent: May 15, 2001

(54) OPERATION MECHANISM FOR A PARASOL

(76) Inventor: Jin-Sheng Lai, 4F, No. 77, Sec. 4, Nan-Jing E. Rd., Taipei (TW)

( * ) Notice: Subject to any disclaimer, the term of this patent is extended or adjusted under 35 U.S.C. 154(b) by 0 days.

(21) Appl. No.: 09/317,982

(22) Filed: May 25, 1999

(51) Int. Cl.[7] ..... A45B 17/00; A45B 25/14; B65H 75/30

(52) U.S. Cl. ..... 135/20.3; 242/395

(58) Field of Search ..... 242/395; 135/20.3

(56) References Cited

U.S. PATENT DOCUMENTS

| | | | | |
|---|---|---|---|---|
| 3,175,568 | * | 3/1965 | Kafka | 135/20.3 |
| 4,674,522 | * | 6/1987 | Ma | 135/20.3 |
| 4,877,045 | * | 10/1989 | Lin | 135/20.3 |
| 4,878,509 | * | 11/1989 | Tung | 135/20.3 |
| 5,711,333 | * | 1/1998 | Vanderminden | 135/20.3 |

* cited by examiner

*Primary Examiner*—Robert Canfield

(74) *Attorney, Agent, or Firm*—Varndell & Varndell, PLLC

(57) ABSTRACT

An operation mechanism for a parasol, including a deflection mechanism, a winding mechanism, a damper mechanism and a clutch mechanism. The deflection mechanism is installed on a locating seat. An upper and a lower sections of the locating seat are formed with upper and lower pin holes. Two shaft rods at two ends of a spiral rod are passed through the upper pin holes with the spiral rod received in the locating seat. One side of the locating seat is rotatably fixed with a first gear. A bottom of a swinging head is formed with a spiral toothed face engaged with and driven by the spiral rod. The winding mechanism and damper mechanism are passed through the lower pin hole. The clutch mechanism connected with a crank is disposed at one end of the winding mechanism. When rotating the crank, the winding mechanism is driven to wind a cord for stretching open the parasol face. When the crank is pulled outward, a second gear of the clutch mechanism is engaged with the first gear of the deflection mechanism so that the deflection mechanism can be driven to adjust the deflection angle of the parasol. By means of pulling out the crank, the operation of the winding mechanism and deflection mechanism can be switched to stretch open the parasol face or deflect the parasol face.

3 Claims, 8 Drawing Sheets

OPERATION MECHANISM FOR A PARASOL

BACKGROUND OF THE INVENTION

The present invention relates to an operation mechanism for a parasol, in which a cord winding mechanism and deflection mechanism are combined. A crank mechanism is used to switchably operate both the cord winding mechanism and the deflection mechanism for stretching open the parasol face or folding the parasol stem by a certain deflection angle in accordance with the oblique angle of the sunlight.

A conventional parasol is used to shade the sunlight or decorate a garden yard. The conventional parasol is composed of a parasol face, a stem, a seat, a wire winder and other operation mechanisms. Generally, the operation mechanisms only have the functions of stretching and collecting the parasol face of the conventional parasol.

After the parasol face is stretched open to shade the sunlight, in the case that the sunlight is projected by an oblique angle. The parasol face cannot be deflected in accordance with the angle of the sunlight so as to effectively shade the sunlight. In order to solve this problem, a parasol equipped with a folding mechanism has been developed. FIG. 8 is a perspective exploded view of the conventional folding mechanism of the parasol stem, which includes an upper member 10 and a lower member 20. The center of the upper member 10 is formed with a pin hole 11. A back face of a bottom board body of the upper member is disposed with a key slot 12. The lower member 20 is disposed with a cartridge section 21 and a push button 22. The push button 22 is formed with a key tooth 23 and a spring cavity 24 in which a spring 25 is received. The push button 22 is inserted into a socket 26 of the lower member 20 and then the upper member 10 is placed into the cartridge section 21 of the lower member 20. A pin member 27 is passed through the pin hole 11 to lock with a nut 28. When it is desired to change the deflection angle of the parasol, the push button 22 is pressed inward and then the stem connected between the upper member 10 and the parasol face is folded to achieve a desired deflection angle corresponding to the oblique angle of the sunlight.

The above operation procedure cannot be conveniently manually performed. The parasol face is stretched or collected by a manually operated crank, while the deflection angle of the parasol face is adjusted by other operation mechanisms. Moreover, the push button for adjusting the deflection angle of the parasol face is generally arranged at a relatively high position. Therefore, a user needs to press the push button with one and hold and fold the parasol stem with the other hand. Such operation necessitates both hands and is thus inconvenient and strength-consuming for the user.

Moreover, the folding mechanism of the conventional parasol as shown in FIG. 8 can only achieve a deflection function in one single direction. Most part of the parasol stem is connected with a bottom weight for achieving a stabilizing effect. Basically, the angles of the sunlight in sunrise and sunset are varied by 180 degrees on the same plane. The conventional folding mechanism is not applicable to shade the sunlight within the range of 180 degrees on a plane unless the bottom weight is together with the parasol stem lifted to rotate the parasol face. Such procedure is laborious and not practical.

SUMMARY OF THE INVENTION

It is therefore a primary object of the present invention to provide an operation mechanism for a parasol, in which a cord winding mechanism and deflection mechanism are combined. A crank mechanism is used to switchably operate both the cord winding mechanism and the deflection mechanism for stretching open the parasol face or folding the parasol stem by a certain deflection angle. Therefore, the folding mechanism of the parasol is simplified. A clutch mechanism is engaged between the winding mechanism and the swinging head of the deflection mechanism. By means of rotating a single crank, the clutch mechanism is engaged with either the winding mechanism or the deflection mechanism so as to stretch open the parasol face or deflect the parasol face.

It is a further object of the present invention to provide the above operation mechanism in which a damper mechanism is disposed to provide a frictionally damping effect so as to prevent the parasol face from sliding downward.

It is still a further object of the present invention to provide the above operation mechanism which is able to deflect the parasol leftward or rightward on the same plane so as to meet the different oblique angles of the sunlight in sunrise and sunset.

According to the above objects, the operation mechanism for the parasol of the present invention includes a deflection mechanism, a winding mechanism, a damper mechanism and a clutch mechanism. The deflection mechanism is installed on a locating seat. An upper and a lower sections of the locating seat are formed with upper and lower pin holes. Two shaft rods at two ends of a spiral rod are passed through the upper pin holes with the spiral rod received in the locating seat. One side of the locating seat is rotatably fixed with a first gear. A bottom of a swinging head is formed with a spiral toothed face engaged with and driven by the spiral rod. The winding mechanism and damper mechanism are passed through the lower pin hole. The clutch mechanism connected with a crank is disposed at one end of the winding mechanism. When rotating the crank, the winding mechanism is driven to wind a cord for stretching open the parasol face. When the crank is pulled outward, a second gear of the clutch mechanism is engaged with the first gear of the deflection mechanism so that the swinging head of the deflection mechanism can be driven and deflected to adjust the deflection angle of the parasol. When the parasol is stretched open to a limit position, the damper mechanism provide a frictionally damping effect for preventing the parasol from sliding downward. By means of one single crank, the operation of the winding mechanism and deflection mechanism can be both performed.

The present invention can be best understood through the following description and accompanying drawings wherein:

DETAILED DESCRIPTION OF THE PREFERRED EMBODIMENT

Figure 1:
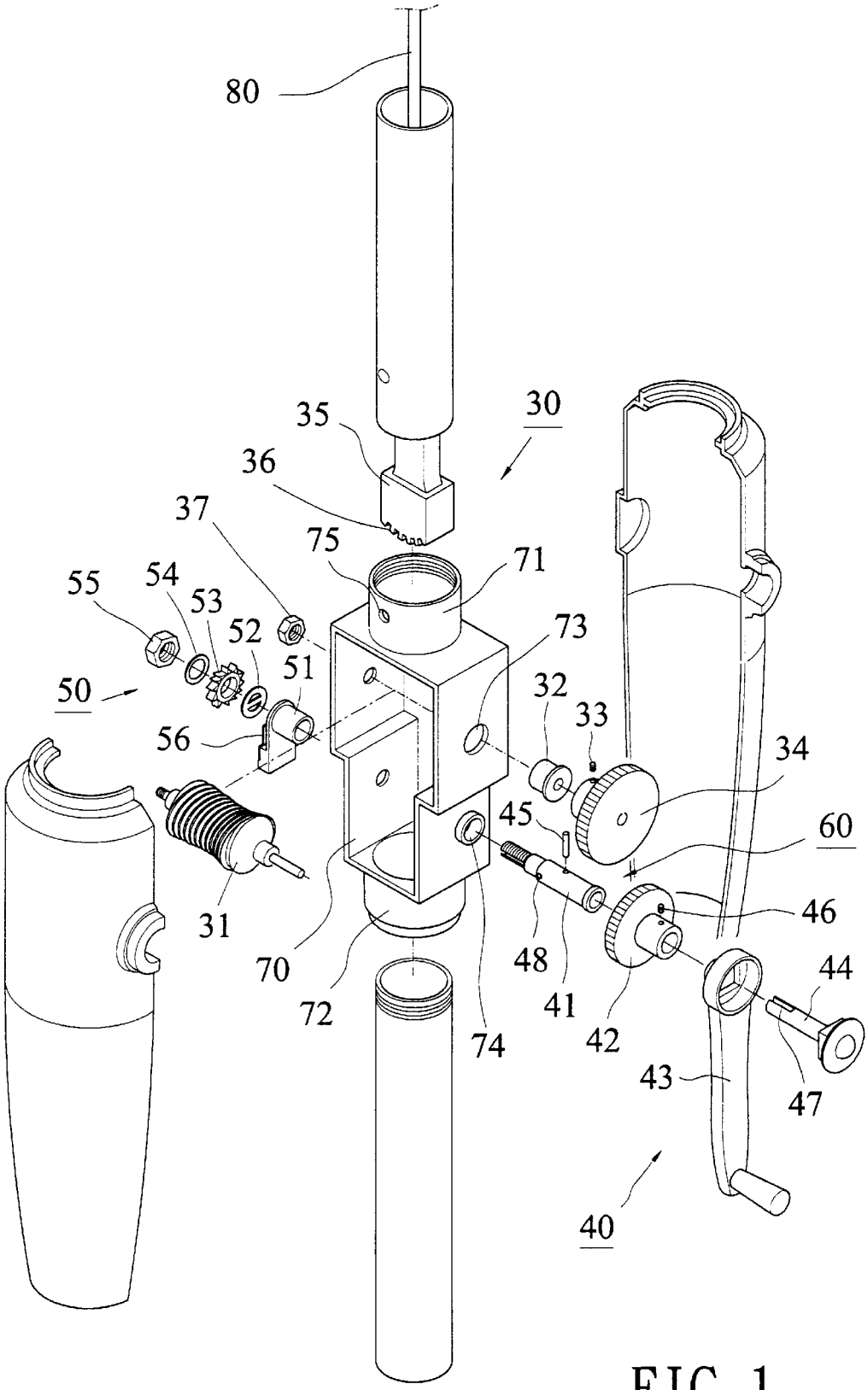
FIG. 1 is a perspective exploded view of the operation mechanism of the present invention.

Please refer to FIG. 1. The operation mechanism of the parasol of the present invention includes a deflection mechanism 30, a winding mechanism 40, a damper mechanism 50 and a clutch mechanism 60.

Figure 4:
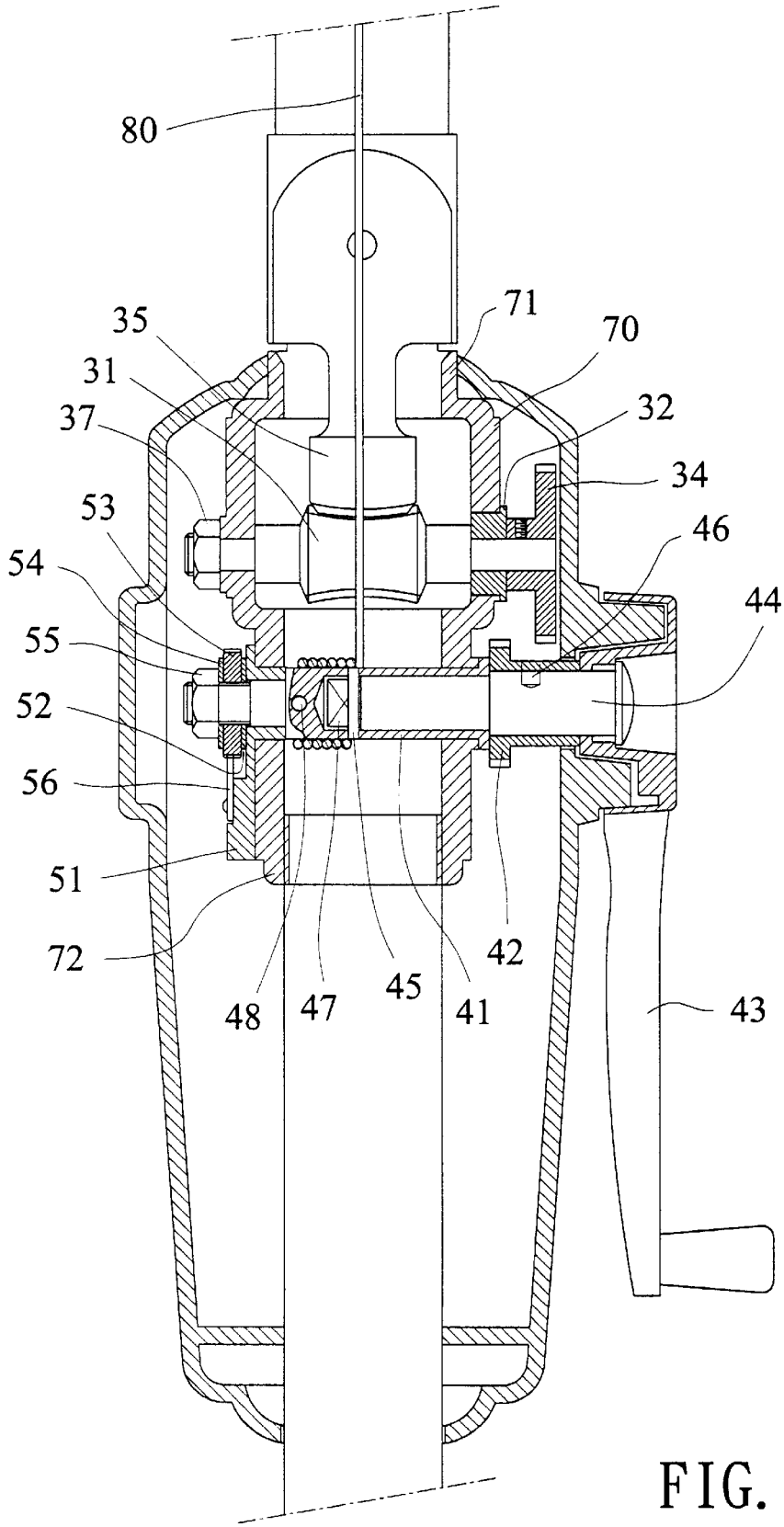
FIG. 4 is a sectional view showing that the crank is pushed inward and the clutch mechanism is engaged with the deflection mechanism of the present invention.
Figure 5:
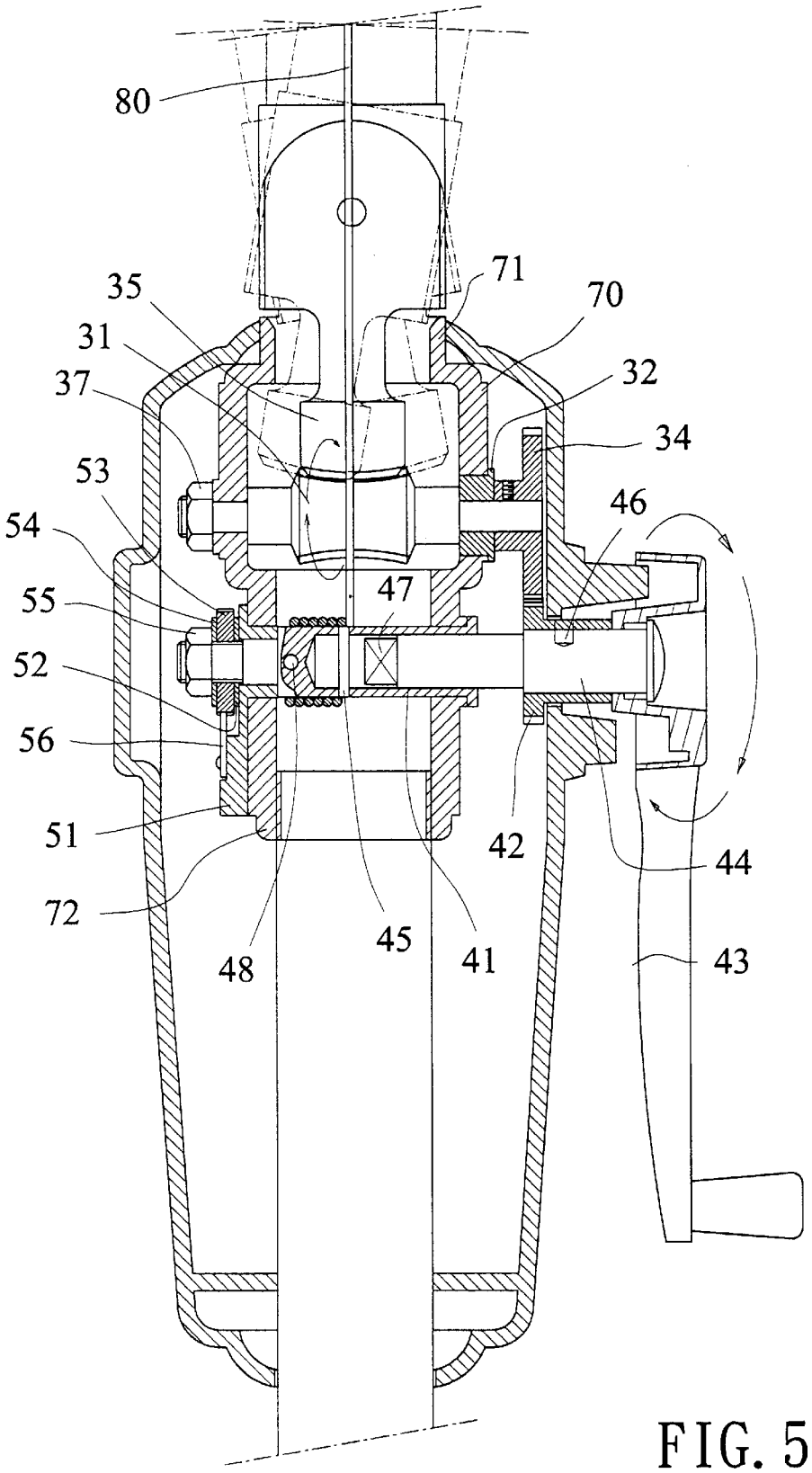
FIG. 5 is a sectional view showing that the crank is pushed inward and the clutch mechanism is engaged with the winding mechanism of the present invention.

The deflection mechanism 30 is installed on a locating seat 70. The upper and lower ends of the locating seat (or housing) 70 are respectively disposed with upper tube section 71 and a lower tube section 72. The lower tube section 72 can receive a supporting pole. An upper and a lower sections of the locating seat are formed with upper and lower pin holes 73, 74. Two shaft rods at two ends of a spiral rod 31 are passed through the upper pin holes 73 from inner side of the seat body to the outer side thereof. One side of the locating seat (or housing) 70 is rotatably fixed with a pad member 32 and a screw 33 for locking with a first gear 34. The other side thereof is disposed with a nut 37 for locking the shaft rod of the spiral rod 31. A parasol pole with a swinging head 35 is locked with the pin holes 75 of the upper tube section 71. The bottom of the swinging head 35 is formed with a spiral toothed face 36 engaged with and driven by the spiral rod 31. Accordingly, when the first gear 34 is rotated, the spiral rod 31 is rotated therewith. At this time, through the spiral toothed face 36, the swinging head 35 is swung and deflected. In the case that the spiral rod 31 is clockwise rotated, the upper end of the swinging head 35 is deflected rightward. Reversely, in the case that the spiral rod 31 is counterclockwise rotated, the upper end of the swinging head 35 is deflected leftward as shown in FIGS. 4 and 5.

Figure 2:
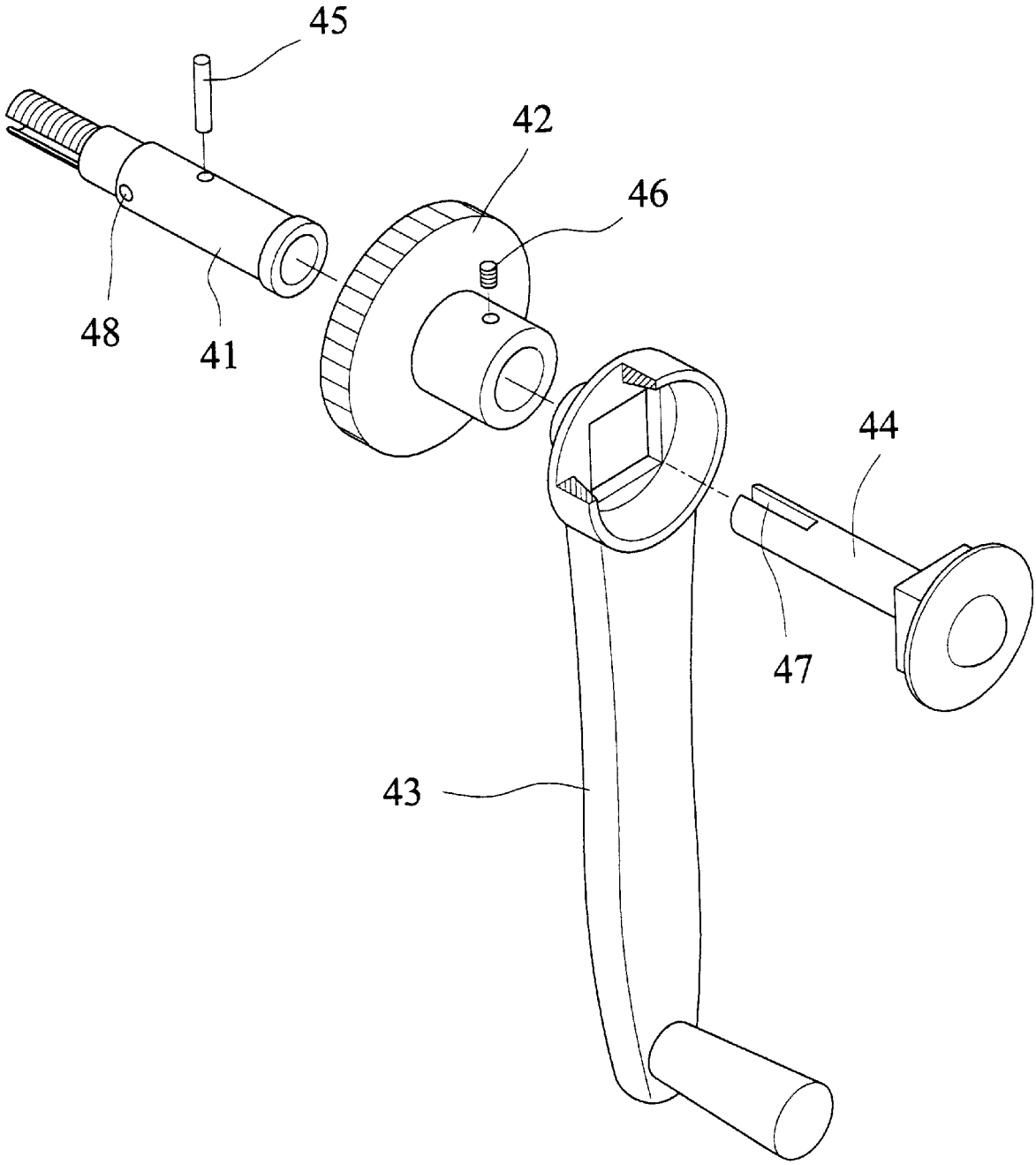
FIG. 2 is a perspective exploded view of the winding mechanism of the present invention.

Referring to FIG. 2, the winding mechanism 40 is composed of a crank shaft 41,a second gear 42, a crank 43, an engaging pin 44, an insertion pin 45 and small screw 46. The crank shaft 41 is passed through the lower pin hole 74. The engaging pin 44 is passed through the crank 43 and second gear 42 and then fitted into the crank shaft 41. The insertion pin 45 is inserted into the crank shaft 41 and engaged in an engaging groove 47 of the engaging pin 44. By such engagement, the crank 43 can be rotated to drive the crank shaft 41 to synchronously rotate.

Figure 3:
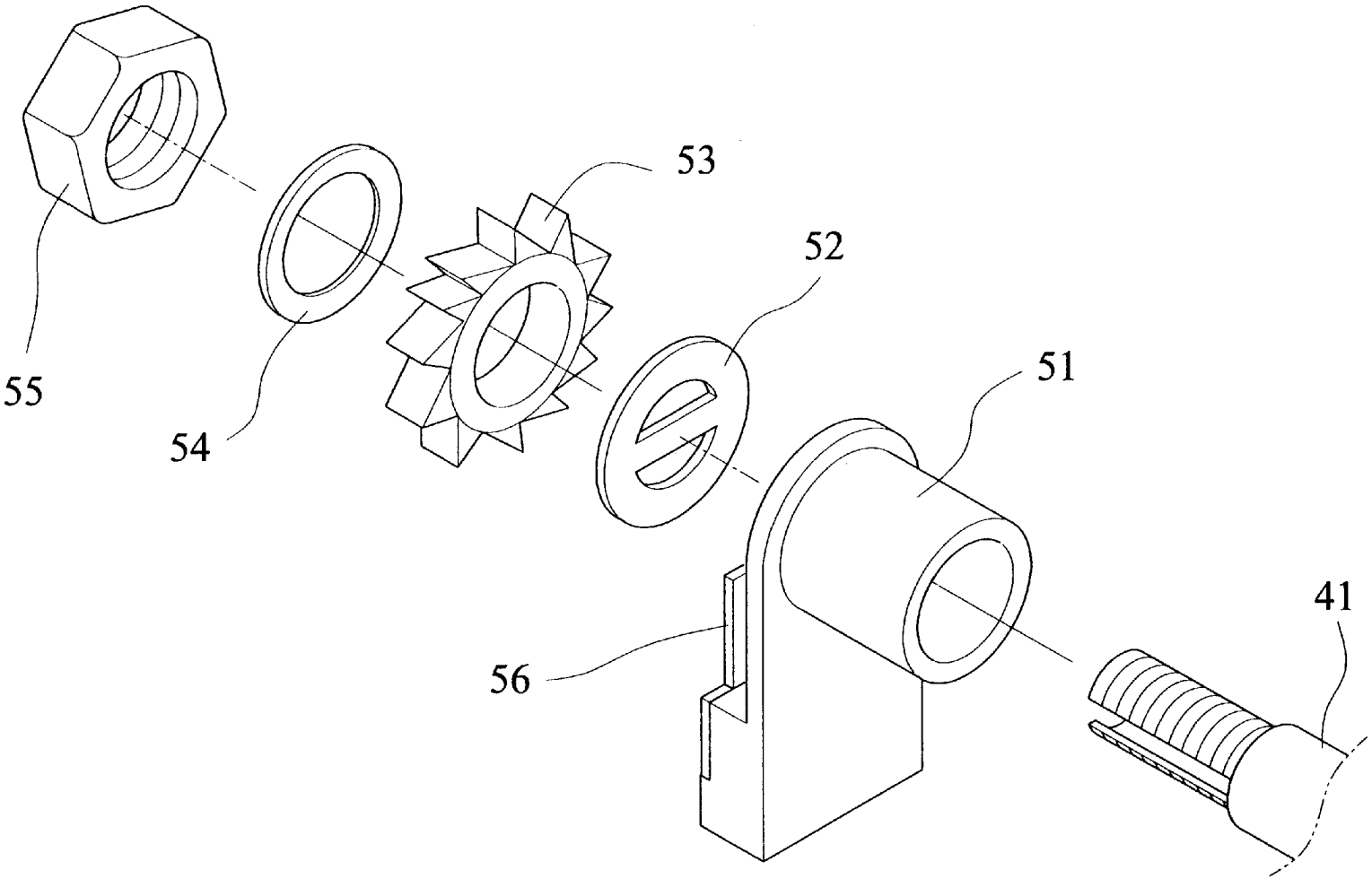
FIG. 3 is a perspective exploded view of the damper mechanism of the present invention.

As shown in FIG. 3, the damper mechanism 50 includes a pad sleeve 51, a washer 52, a ratchet gear 53, a resilient gasket 54 and a tightening nut 55. A rear section of the crank shaft 41 is passed through the locating seat (or housing) 70 and then continuously serially passed through the respective components of the: damper mechanism and finally tightened by the tightening nut 55. A click 56 is fixedly disposed on a certain portion of the pad sleeve 51. When rotating the crank 43, the ratchet gear 53 is tightened by the nut 55 to make the washer 52 rotate therewith so as to stretch open the winding cord of the parasol. When winding cord of the parasol is unwound by the winding mechanism 40 and the parasol is opened to a limit position, the ratchet gear 53 is stopped by the click 56 and is subject to a frictionally damping effect of the washer 52, the parasol face is prevented from sliding downward. When the crank 43 is reversely rotated, the washer 52 rotatably fixed with the crank shaft 41 is slided to create a frictional force. Therefore, the crank shaft 41 is provided with a certain torque for driving and making the parasol face moved downward and collected.

The clutch mechanism 60 serves as a switching mechanism. When the engaging pin 44 is pulled out by the crank 43, the engaging groove 47 at rear end of the engaging pin 44 is disengaged from the insertion pin 45. At this time, the second gear 42 is engaged with the first gear 34. When rotating the crank 43, the deflection mechanism 30 is operated, while the winding mechanism 40 will not be rotated.

Figure 7:
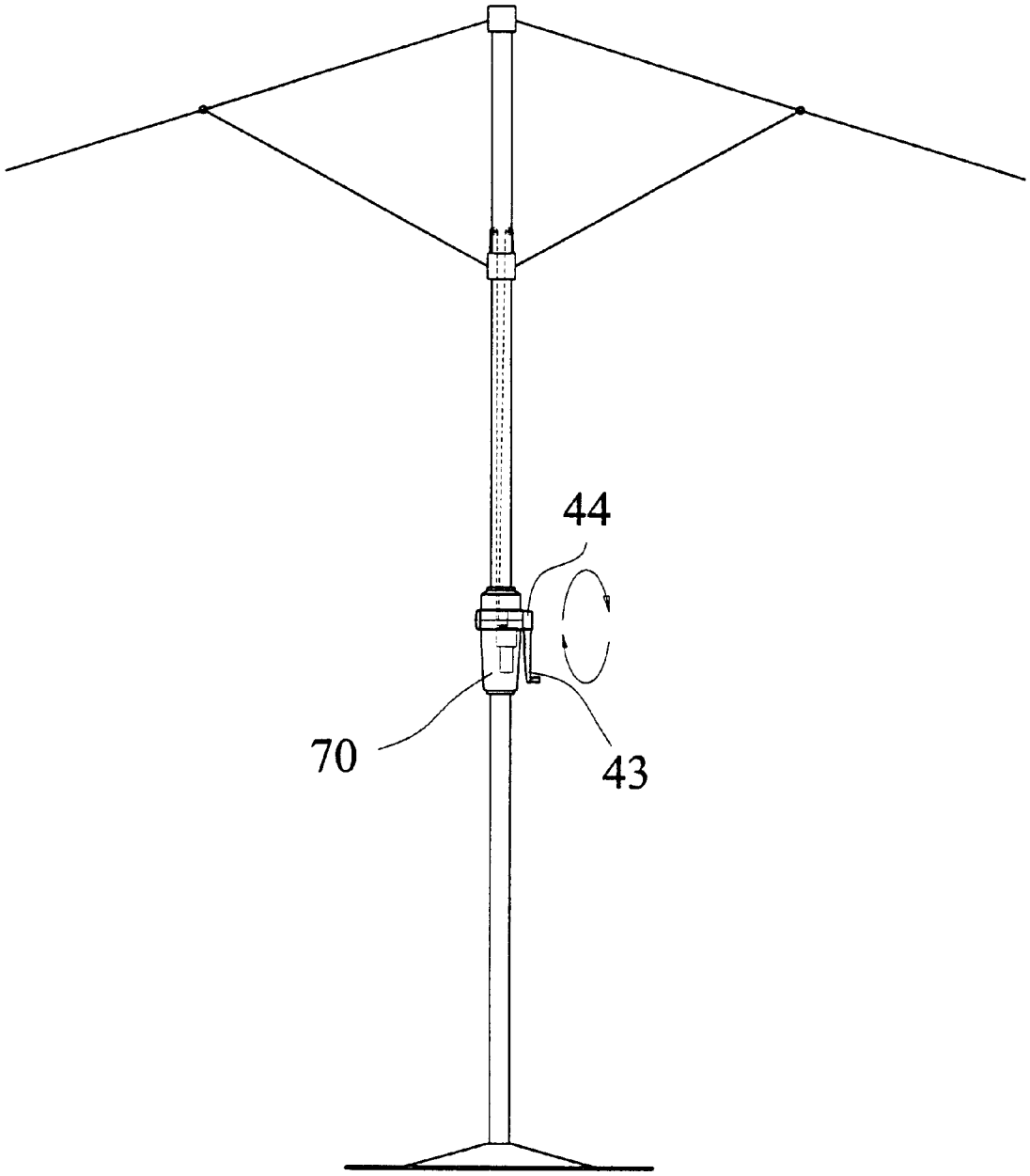
FIG. 7 shows that the parasol of the present invention is stretched open.
Figure 8:
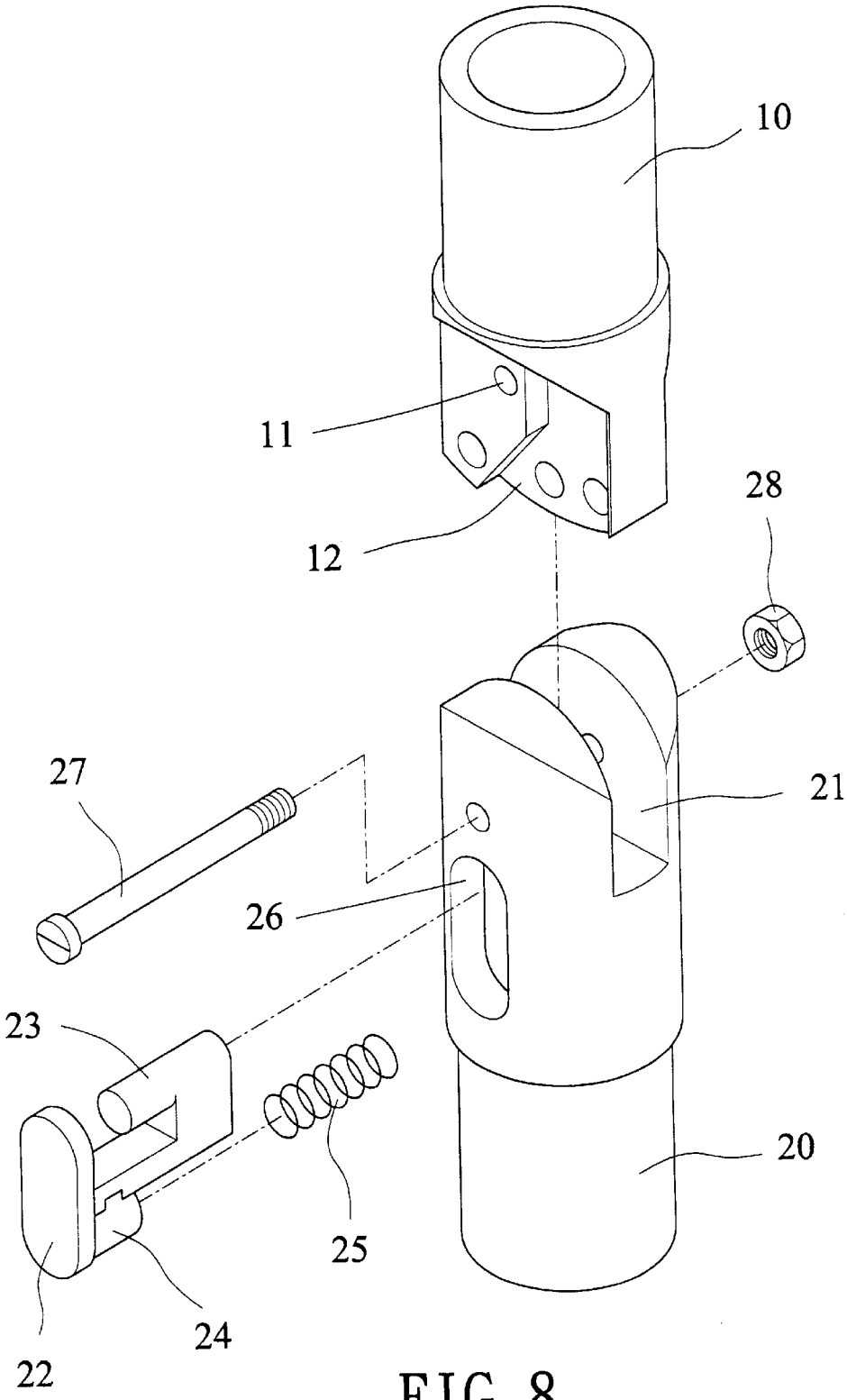
FIG. 8 PRIOR ART
FIG. 8 is a perspective exploded view of a conventional folding mechanism of a parasol.

Referring to FIGS. 5 and 7, when rotating the crank 43, the crank shaft 41 is rotated via the engaging pin 44. At this time, the cord 80 conducted through and tied with the through hole 48 of the crank shaft 41 for controlling the stretching of the parasol face is wound, serving as a winding mechanism 40 for stretching open the parasol.

Figure 6:
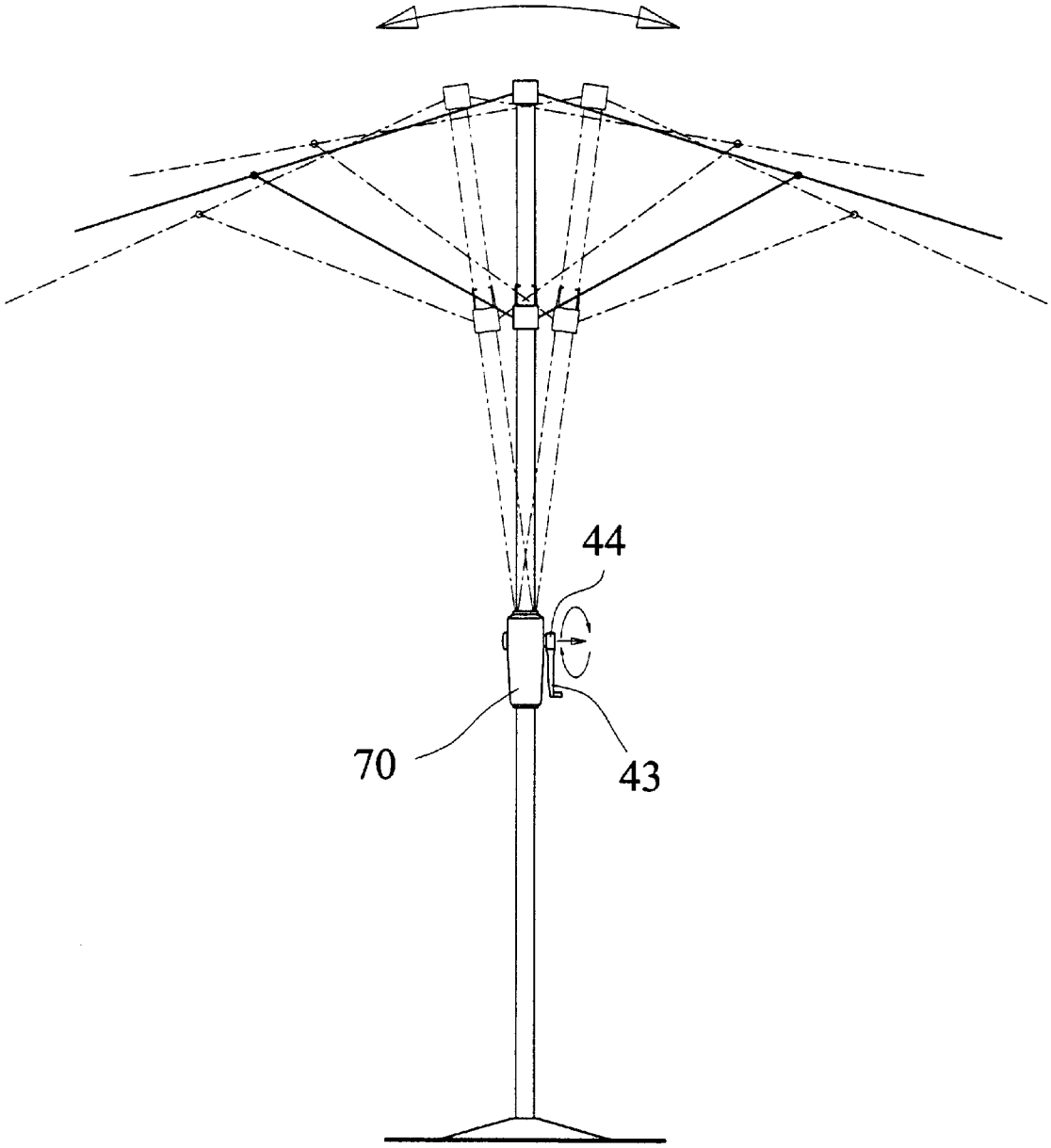
FIG. 6 shows that the parasol of the present invention is deflected.

Referring to FIGS. 4 and 6, when operating the clutch mechanism 60 to disengage the engaging pin 44 from the crank shaft 41, the second gear 42 is engaged with the first gear 34 of the deflection mechanism 30. At this time, the crank 43 is further rotated to guide and drive the spiral rod 31. Through the spiral toothed face 36, the swinging head 35 of the folding mechanism is deflected for effectively shade the sunlight in accordance with the oblique angle of the sunlight.

According to the above arrangement, the mechanism for adjusting the deflection angle of the parasol face and the mechanism for stretching open the parasol face are combined. By means of the clutching and switching control of one single crank, the parasol can be easily operated with strength saved.

The above embodiment is only used to illustrate the present invention, not intended to limit the scope thereof. Many modifications of the above embodiment can be made without departing from the spirit of the present invention.

What is claimed is:

1. An operation mechanism for a parasol, comprising a housing, a deflection mechanism, a clutch mechanism, and a winding mechanism cooperating together to open and close the parasol and to tilt the parasol from side to side, the housing including a top with an upper tube section receiving a parasol pole supporting the parasol and a bottom with a lower tube section receiving a supporting pole, the parasol pole being connected to the upper tube section of the housing by a pin and pivoting in the upper tube section of the housing, the parasol pole terminating in a swinging head having a convex spiral toothed face, the deflection mechanism including a spiral rod arranged horizontally in the housing, the spiral rod having a concave spiral toothed face matching and cooperating with the convex spiral toothed face of the parasol pole for tilting the parasol pole when spiral rod is rotated, a first gear connected to the spiral rod; the first gear and the spiral rod having a common axis and arranged so that when the first gear is rotated, the spiral rod is rotated and the parasol pole is tilted, the winding mechanism including a hollow crankshaft, a cord connected between the hollow crankshaft and the parasol, and an insertion pin transversely extending across the hollow crankshaft, the clutch mechanism including an engaging pin sliding within the hollow crankshaft, a second gear secured to the engaging pin and rotating therewith, a crank turning the engaging pin and the second gear, the engaging pin having an engaging groove, the engaging pin sliding within the hollow crankshaft between a first position and a second position; in the first position the crankshaft and the engaging pin are engaged and the crank and the crankshaft rotate together, by the engaging groove of the engaging pin surrounding the insertion pin; and in the second position the crankshaft and the engaging pin are not engaged and the crank can rotate while the crankshaft does not rotate, by the engaging groove of the engaging pin not surrounding the insertion pin, wherein the first and second gears are arranged not to engage when the engaging pin is in the first position, so that turning the crank winds or unwinds the cord of the parasol without tilting the pole of the parasol; and the first and second gears are arranged to engage when the engaging pin is in the second position, so that the pole of the parasol is titled without opening and closing the parasol.

2. An operation mechanism for a parasol as claimed in claim 1, wherein the crankshaft has a rear section extending out of the housing, a damper mechanism is arranged on the rear section of the crankshaft, the damper mechanism including a pad sleeve, a washer, a ratchet gear, a resilient gasket and a tightening nut serially passed over the rear end of the crankshaft and finally tightened by the tightening nut, and a clicker is fixedly disposed on the pad sleeve that engages the ratchet gear.

3. An operation mechanism for a parasol as claimed in claim 1, including a cover surrounding the housing, the deflection mechanism, the clutch mechanism, and the winding mechanism, so that only the crank and a portion of the engaging pin extended outside the cover.

* * * * *